United States Patent [19]

Growney

[11] 4,269,316

[45] May 26, 1981

[54] ICE CREAM CONE PACKAGE

[75] Inventor: Lawrence J. Growney, Pearl River, N.Y.

[73] Assignee: Federal Paper Board Company, Inc., Montvale, N.J.

[21] Appl. No.: 92,684

[22] Filed: Nov. 9, 1979

[51] Int. Cl.[3] ..... B65D 85/62; B65D 5/48; B65D 81/00

[52] U.S. Cl. ..... 206/499; 206/45.19; 206/491; 206/486; 206/521; 229/28 R; 229/42; 426/124

[58] Field of Search ..... 206/492, 491, 45.14, 206/45.19, 526, 499, 564, 486, 521; 229/29 B, 28 R, 30, 42

[56] References Cited

U.S. PATENT DOCUMENTS

| | | | |
|---|---|---|---|
| 2,623,682 | 12/1952 | Candell | 206/491 |
| 3,092,297 | 6/1963 | Bellerive | 206/491 |
| 3,146,112 | 8/1964 | Weinstein | 206/499 |
| 3,175,751 | 3/1965 | Burgess | 229/28 R |
| 3,343,671 | 9/1967 | Weinstein | 206/499 |
| 3,514,031 | 5/1970 | Burgess | 229/28 R |

*Primary Examiner*—William T. Dixson, Jr.
*Attorney, Agent, or Firm*—Guy A. Greenawalt

[57] ABSTRACT

A package for ice cream cones or similar articles of a fragile nature and like configuration in which the articles are disposed, in stacked and telescoped relation in an insert, formed of paperboard or similar material, which, when set up in the form of a tray to receive the cones, is adapted to be enclosed in an outer carton, and which includes spaced cross panel members for engaging the cones so as to form a cushioned restraint against axial movement and minimize the risk of breakage during handling of the package.

10 Claims, 8 Drawing Figures

ICE CREAM CONE PACKAGE

BACKGROUND OF THE INVENTION

This invention relates to packaging of articles of a fragile nature and is more concerned with improvements in a package having an insert for holding ice cream cones in position in a carton so as to resist movement and minimize possible damage in handling and shipment.

The packaging of articles which are fragile and liable to be damaged in handling has presented problems for the package designer which have been difficult of solution. One of the consumer products which has been most difficult to package in a satisfactory manner has been ice cream cones which are marketed for home consumption. Generally these have been packaged in relatively small groups, for example, ten or twelve, in a paperboard carton, generally of relatively light weight or guage paperbaord material. In some packages the cones have been arranged in telescoped assembly or stacks with a relatively small number in a stack and generally with two stacks thereof enclosed in a tubular carton of rectangular cross-section which enables maximum convenience in multiple unit shipment and shelf display in the retail store. In some packaging arrangements designed heretofore the stack, or stacks, of cones have been enclosed also in an inner wrapper in the form of a plastic bag, usually sealed for protection against moisture, etc. In some other arrangements the stack or stacks of the cones have been cradled in an insert of foldable sheet material in an effort to provide further protection against damage in handling. None of these arrangements have proven satisfactory and the consumer often finds, upon opening such packages breakage of a character which renders the cones useless.

It is, therefore, a general object of the invention to provide a packaging arrangement for a group of articles of this type which affords greater protection than provided heretofore, against damage to the articles, when the package is subjected to exterior forces by rough handling or the like.

It is a more specific object of the invention to provide a packaging arrangement for an assembly of ice cream cones or similar cone-shaped articles of a fragile nature which are in telescoped and stacked relation wherein the stacked articles are nested in a paperboard insert so that the individual cones are cushioned against movement when the assembly is enclosed in an outer carton.

It is a further object of the invention to provide an insert for a package of the type described which is formed from foldable sheet material, such as paperboard, which is cut and scored so as to be set up in the form of a tray with spaced cross partition forming panel members which engage the articles and cushion the same against axial movement so as to reduce the risk of damage resulting from pressure between the articles.

It is another object of the invention to provide a package of ice cream cones or cone-shaped articles of similar character which are of a fragile nature wherein the articles are arranged in stacks and nested in a protective tray formed of a sheet of cut and scored paperboard or similar material which, when set up to receive the articles, includes cross partition forming panels which are spaced so as to engage the rims of the individual articles in the stacks and provide cushioned restraint against damaging compacting of the articles in the stack.

To this end the invention as claimed is embodied in a packaging arrangement which includes a tray-like holder for a stack of cone-shaped articles in which the articles are restrained against axial movement by cross partition forming panel members in the holder which are spaced so as to engage in cushioning relation the individual articles.

The foregoing and other objects and advantages will become more apparent when reference is made to the accompanying detailed description of the preferred embodiment of the invention, which is set forth therein by way of example and shown in the drawings wherein like reference numerals indicate corresponding parts throughout.

DESCRIPTION OF THE PREFERRED EMBODIMENT OF THE INVENTION

Figure 1:
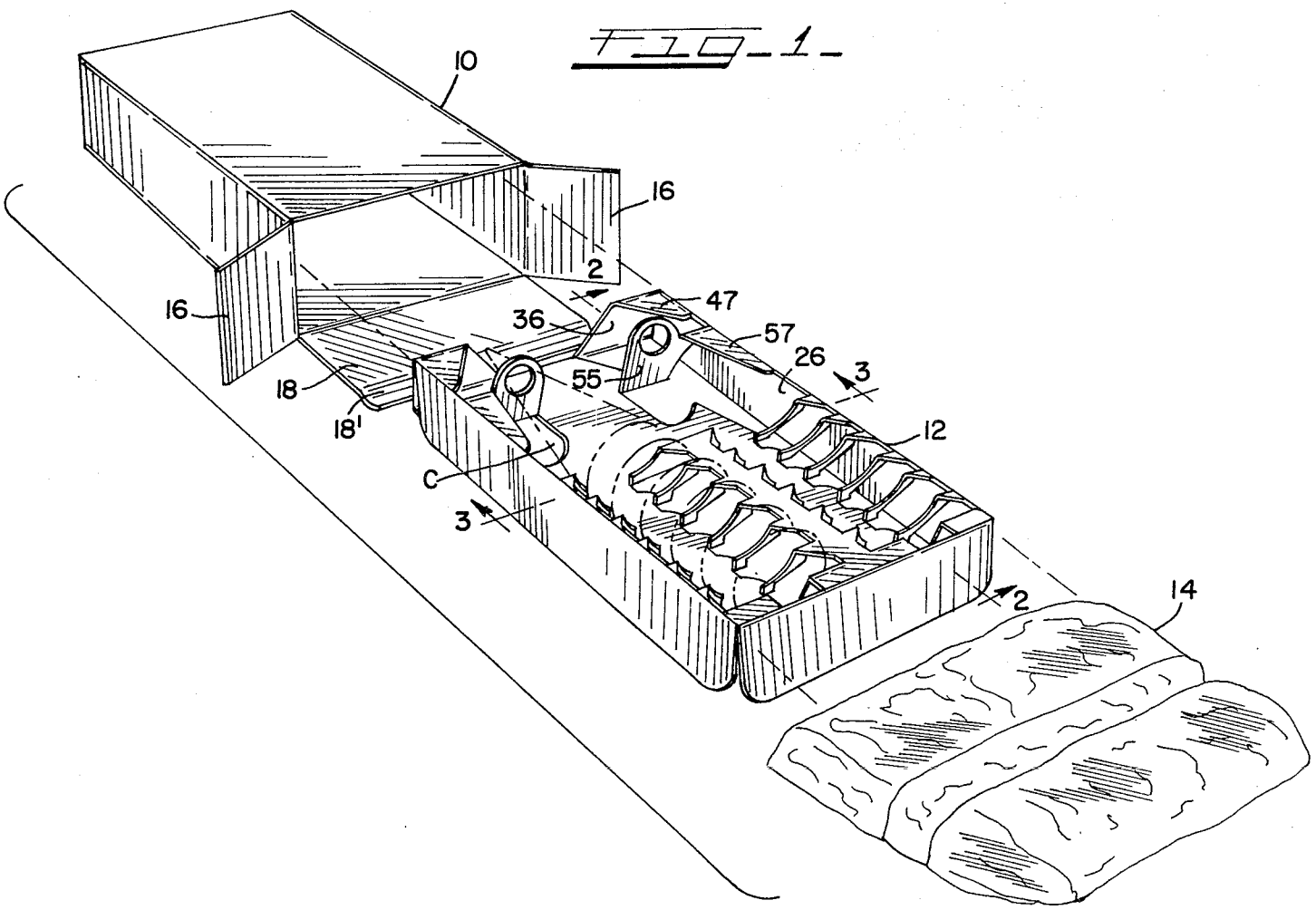
FIG. 1 is an exploded perspective view of a package which embodies the principles of the invention, with a stack of the articles being indicated in phantom line.

Referring to the drawings, there is illustrated in FIG. 1 a package arrangement for an assembly of ice cream cones C or other fragile articles of similar cone-shaped configuration which comprises an outer carton 10, an insert in the form of a partitioned tray 12 which is adapted to hold two stacks of 6 cones each and a flexible bag 14 which may be formed of transparent plastic, such as, for example, Cellophane, and which is adapted to enclose the cone-filled tray 12 before it is inserted in the carton 10.

The outer carton 10 is of conventional construction and may be formed of foldable paperboard of suitable guage or weight. As shown, when set up, it has a tubular shape and rectangular cross section, with end closures comprising a pair of dust flaps 16 and a closure flap 18, the latter having a conventional tuck flap 18'.

Figure 4:
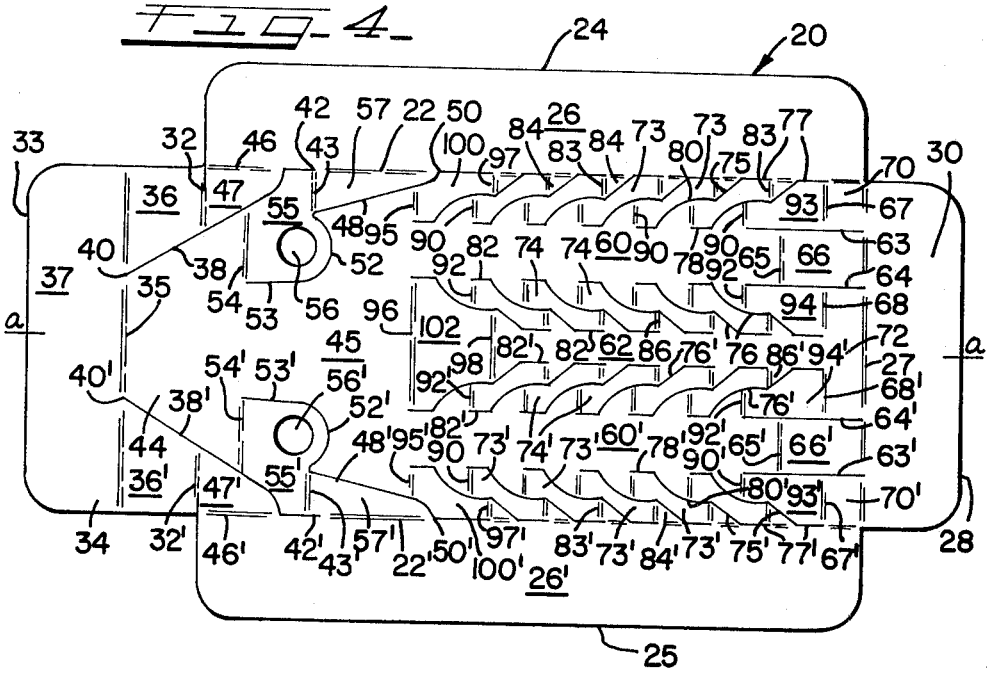
FIG. 4 is a plan view of a paperboard blank which is cut and scored for forming an article holding tray which is adapted to be inserted in an outer carton when it has been filled with the articles and enclosed in a bag of flexible plastic sheeting.

The cone holding tray 12 is formed from a generally rectangular sheet or blank 20 of paperboard material, of suitable gauge or weight, which is cut and scored as shown in FIG. 4 enabling it to be set up with provision for nesting therein two stacks of the cones C in such a manner that they will be restrained against movement, particularly, in an axial direction so as to prevent jamming in the stack and breaking which is likely to result from handling when there is insufficient restrain of movement.

The blank 20 is cut and scored so that it is generally symmetrical about a longitudinal center line indicated at a–a in FIG. 4 and where an element on one side of the line a–a is identified by a numeral, a corresponding element on the other side of the line a–a will be identified by the same numeral primed. The blank is notched out at the four corners and partially cut, partially scored, on the longitudinally extending, transversely spaced, parallel fold lines 22, 22' with the latter spaced inwardly equal distances from the side edges 24, 24' of the blank so as to form along opposite sides margins of the blank rectangular side wall panels 26 wnd 26' of equal size and like configuration which extend outboard of the fold lines 22 and 22', the latter being adapted to form the top side edges in the set up tray.

At the one end, the blank 20 is scored on the transverse line 27 which is spaced inwardly of the end edge 28 of the blank a distance equal to the distance between the lines 22 and 22' and the side edges 24, 24' of the blank, so as to define a rectangular end wall panel 30, which is adapted to fold or hinge on the top edge defining score line 27 in forming the tray. At its opposite end, the blank 20 is scored on a transverse line 32, 32' extending between the ends of the longitudinal score lines 22 and 22' and is spaced inwardly of the end edge 33 of the blank a distance greater than the distance between the parallel lines 27 and 28 at the other end of the blank. The end panel portion 34 which extends outboard of the line 32, 32' is divided by a parallel, transverse score line 35, into two panel portions 36, 36' and 37. The panel portion 36, 36' is divided into two sections as shown, by diagonal cutting lines 38 and 38' which extend in diverging relation from spaced points 40, 40' on the score line 35 to points 42, 42' on the side edge defining lines 22 and 22' which points 42, 42' are at the outboard ends of short hinge score lines 43, 43' hereinafter referred to. The terminal ends 40, 40' of the cutting lines 38, 38' are spaced equidistant from the longitudinal center line a–a and the opposite ends are spaced equidistant from the outboard ends of the transverse hinge score line 32, 32'. The distance between the hinge score lines 32, 32' and 35 is somewhat less than the distance between the lines 27 and 28 at the other end of the blank, so that, when the double section panel 36, 36' is turned down about the hinge line 32, 32' and the associated end panel 37 is hinged about the line 35 into engagement with the bottom face or surface of the floor of the tray, the end wall formed by the double section panel 36, 36' is of somewhat lesser depth than the end wall forming panel 30 at the other end of the blank to facilitate loading into the outer carton 10.

The score lines 22, 22', 27 and the portion of the score line 35 which extends between the points 40, 40', together with the diagonal cutting lines 38, 38', define a center portion 44 of the blank 20 which is further cut and scored so that portions thereof may be moved into an offset position to form the floor 45 (FIGS. 2, 3 and 4) of the tray while other parts thereof remain in a top wall forming position and are hingedly connected to the floor panel portions by a plurality of pairs of cross partition forming strips which strips, in the fully set-up position of the tray, are disposed in generally vertical planes and spaced so as to engage with predetermined portions of the cones. The blank 20, as illustrated, is adapted to form a tray to hold two stacks of the cones in side-by-side relation. The section 44 of the blank is cut and scored so that it is symmetrical about the longitudinal center line a–a with the floor forming panel portions being cut and scored so that they are released for hinging movement, about transverse hinge score lines, to the bottom floor forming position shown in FIGS. 2 and 3. The cutting and scoring on opposite sides of the line a–a is the same and where there is an element on one side the line and corresponding element on the other side the latter will be identified by the same numeral primed. At the one end of the blank the panel portions of the blank section 44, which are adapted to hinge to floor forming position, are released in part by the diagonally, diverging pair of cutting lines 38, 38'. The end wall forming panel 36, 36' serves as a hinge plate and is adapted to swing about the transverse hinge lines 32, 32' and 35 into a vertical plane. The diagonal cutting lines 38, 38' together with the associated score lines 32, 32' and end portions 46, 46' of the side edge hinge score lines 22 and 22' define triangular corner web panels 47, 47' which constitute reinforcing panels in the plane of the top wall of the tray in the set-up position. Cutting lines 48, 48' extend inwardly in converging relation from points 50, 50' on the side edge score lines 22, 22' which are spaced a predetermined distance from the ends 42, 42' of the cutting lines 38, 38' and merge into cutting lines 52, 52' which are circular segments and which extend to one end of short, parallel cutting lines 53, 53', the latter extending longitudinally of the blank and disposed in transversely spaced equidistant relation on opposite sides of the line a–a. The cutting lines 53, 53' extend to the inner ends of relatively short transversely aligned hinge score lines 54, 54' which terminate at the diagonal cutting lines 38, 38'. The hinge score lines 54, 54' are spaced from the hinge score lines 43, 43' a distance substantially the same as the distance between the hinge score lines 35 and 32, 32' so that small cross partition forming panels 55, 55', resulting from the previously described cutting and scoring of the blank, serve as hinge plates in the same manner as panel sections 36, 36'. These panels are, however, apertured at 56 and 56' to receive in supporting relation, the bottom ends of the bottommost cones in the stacks.The cutting line configuration results in leaving small triangular panels 57, 57' which remain in the plane of the top wall of the tray when the portions of the blank section 44 which form the bottom wall 45 are moved into bottom wall forming position.

The portion of the section 44 of the blank which extends from the area of the cone engaging panels 55, 55' to the top edge forming transverse score line 27 in FIG. 4 is cut and scored to provide a pair of relatively narrow bottom wall forming panel strips, 60, 60' which extending longitudinally of the blank and which are latterly spaced equidistant on opposite sides of the longitudinal center line a–a, each with its outboard edge spaced inwardly of the side edge 22, 22' a predetermined distance. The panel material is also cut to provide a narrow top wall forming panel strip 62, which extends longitudinally of the blank and straddles the center line a–a with its opposite side edges spaced a predetermined distance from the inside edges of the adjacent panel strips 60, 60'. The two outboard bottom wall forming panel strips 60, 60' are cut and scored so that they remain in the plane of the other bottom wall forming portions of the blank section 44 while the top wall forming panel strip 62 is cut and scored so that it remains in the plane of the top wall when the bottom wall 45 is formed, which occurs when the multiple panel portions forming the same are swung into bottom wall forming position by hinging and folding operations which are hereinafter described and which include depressing and longitudinally moving the bottom wall forming portions relative to the top wall forming portions of the blank, the respective top and bottom wall forming panel portions being connected by a plurality of small panel members which constitute cone engaging cross partition elements and also serve as hinge plate connecting elements in setting up the tray.

At the end of the blank where the transverse hinge score line 27 defines the top end edge of the tray, pairs of parallel, longitudinally extending transversely spaced cutting lines 63, 64 and 63', 64' extend in the direction of the other end of the blank a predetermined distance and define end portions of the floor forming panels 60 and 60'. Transverse crease lines 65 and 65' extend between the cutting lines of each pair 63, 64 and 63', 64', which crease lines 65, 65' are spaced from the hinge score line 27 a distance corresponding to the distance between the hinge score lines 43, 54 and 43', 54' adjacent the opposite end of the blank. The cut and score lines 63, 64, 65 and 63', 64' and 65' form, with portions of the score line 27, hinge plate panels 66 and 66' which permit downward hinging and longitudinal movement of the strip panels 60 and 60' into bottom wall forming positon. The material adjoining the cutting lines 63, 64 and 63', 64' which extends on opposite sides of each pair thereof, is scored on a transverse line which is parallel with the score line 27 and spaced a short distance from line 27, as indicated at 67, 68 and 67', 68', so as to define the inner edge of small top wall forming panel sections 70, 70' which are located at the outer sides and which are disposed between the cutting lines 63, 63' and the end portions of the score lines 42 and 42'. The cutting lines 64, 64' and score lines 68, 68' cooperate with the central portion of the score line 27 in defining a central panel portion 72 which is at the end of the panel 62 and which is integral with the latter.

The material in the blank sections which lie in the area outboard of the bottom wall forming strip portions 60, 60' and extend between the latter and the top wall forming strip portion 62 is cut and scored to form a plurality of relatively narrow hinged cross partition forming and cone holding panels which are in transversely aligned pairs 73, 74 and 73', 74', each area providing a series of spaced panels 73, 73' extending along the side edge forming score lines 46, 46' and a mirror image series 74, 74' extending in spaced relation in the area adjacent the center line a–a. These cross partition panels, which are spaced according to the spacing of the cones, are formed in an identical manner by longitudinally spaced cutting lines 75, 76 and 75', 76' with the innermost cutting lines 76, 76' being mirror images of the outermost cutting lines 75, 75'. Each of the cutting lines 75, 75' comprises a small outer end portion 77, 77' which coincides with and is spaced along the side edge score line 22, 22' and a similar small inner end portion 78, 78' which is in a parallel line offset in the direction of the panel 60, 60'. The intermediate portions of the cutting lines 75, 75' extend diagonally inwardly at the side edge score lines 22 and 22'. The cutting line portions 78, 78' are aligned with the cutting lines 63, 63' and define side edges of the panel strip portions 60, 60'. The central portion 80, 80' of each of these cutting lines 75, 75' is bowed outwardly as shown. The innermost cutting lines 76, 76' have like end sections 82, 82' which lie in transversely spaced lines on opposite sides of the center line a–a and are spaced longitudinally and which are aligned with the cutting lines 64, 64' so as to define side edges of the panel strip portions 60, 60'. Adjacent the outermost ends of the cutting lines 75, 75' there are short length transverse hinge scores 83, 83' which extend from the outer ends of the bowed cutting line portions 80, 80' to the ends of cutting line end portions 77, 77' of the next succeeding cutting lines 75, 75' and form top hinge lines for each successive partition panel 73, 73' leaving small top wall forming panel portions 84, 84' of triangular shape. Hinge scores 85, 85', similar to scores 83, 83' are provided adjacent the ends of the cutting lines 76, 76' resulting in similar top wall panel portions 86, 86' forming an integral part of top wall forming strip panel 62. At the same end of the blank the parallel longitudinal cutting lines 63, 64 and 63', 64' extend to short hinge crease lines 90, 92 and 90', 92' which extend in transverse alignment from the ends of cutting lines 63, 64 and 63', 64' to the adjacent diagonal cutting lines 75, 76 and 75', 76' so as to form pairs of hinge panels 93, 94 and 93', 94'. At the other ends of the strip panel portions 60, 60' and 62 short transversely aligned hinge scores 95, 95' and 96 at the ends of the innermost cutting lines 75, 75' and 76, 76' cooperate with transversely aligned hinge scores 97, 97' and 98 in forming hinge panels 100, 100' and 102. The hinge arrangement for the cross partition panels 73, 74 and 73', 74' and the hinge panels 93, 94 and 93', 94' at the one end of hinge panels 100, 100' and 102, at the other end, enable the strip panel portions 60, 60' and 62 of the bottom wall to be lowered into position along with the bottom wall forming panel portion 45.

Figure 6:
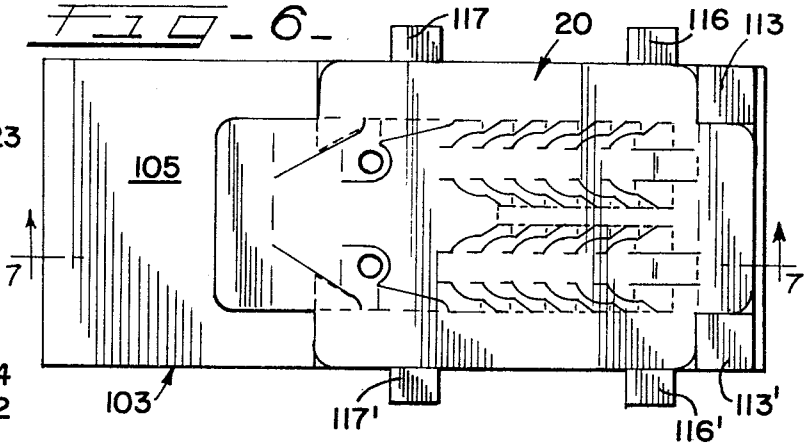
FIG. 6 is a plan view of the base member of the jig of FIG. 5 with the blank of FIG. 4 positioned thereon preparatory to breaking the same.

A jig arrangement for prebreaking the tray insert 12 and enabling it to be set up with ease is illustrated in FIGS. 5 to 8. It comprises a base member 103 and a plunger member 104. The base member 103 comprises a bottom wall forming member 105 and a pair of parallel, upwardly opening recesses 106, 106' which are formed between outside plate members 107, 107' and a center longitudinal plate member 108. The plate 108 has dimensions slightly less than the corresponding width and length of the top wall forming strip panel 62 of the blank 20. A cross plate 110 at the one end of the base 105 has an inside edge face which defines the leading ends of the recesses 106 and 106' and is notched out at 112 and 112' to accommodate the hinge panels 66 and 66' in the blank. Upstanding protuberances in the form of small plates 113, 113' on the ends of end plate member 110 have their oppositely disposed edges 114, 114' spaced apart a distance slightly more than the corresponding distance between the outboard edges of the end wall forming panel 30 of the cut and scored blank 20, with aligned inner edges 115, 115' disposed on a line corresponding to the end edge line 27 on the blank 20. Stop posts 116, 116' are upstanding along opposite sides of base plate 105 adjacent the plate members 113, 113'. Guide and positioning posts 117, 117' are disposed in upstanding relation along opposite sides of base plate 105 and are spaced forwardly of the trailing ends 118, 118' of the side plate members 107, 107'. The guide posts 117 and 117' are spaced apart a distance corresponding to the width of the blank 20. The inner edges 118, 118' of the side plates 107, 107' are spaced apart a distance corresponding to the distance between the side edge lines 22 and 22' of the blank 20 and the center plate 108 is located so that it lies beneath the top wall forming strip panel 62 when the blank is positioned on the base member 103 as shown in FIG. 6.

Figure 5:
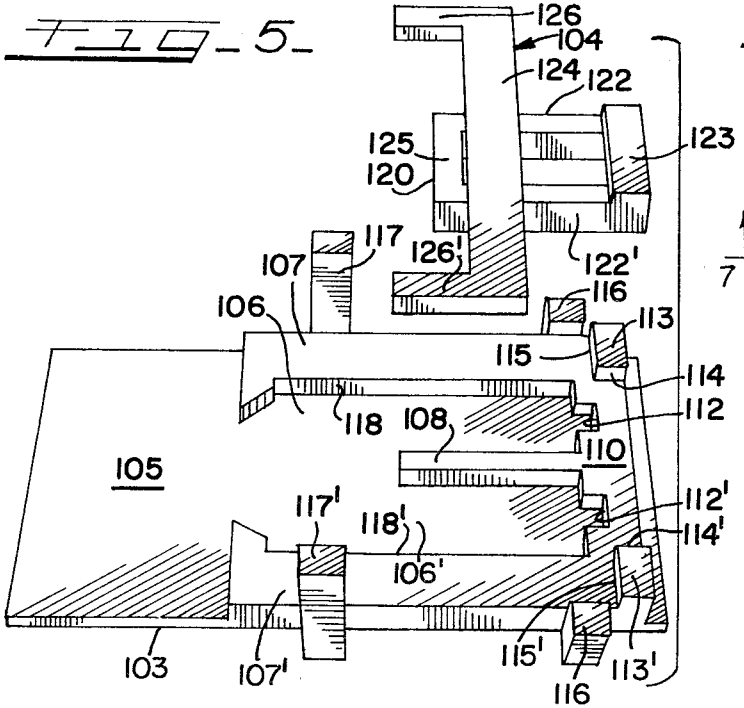
FIG. 5 is an exploded perspective view of a jig assembly for use in prebreaking the blank preparatory to setting up the article holding tray.
Figure 7:
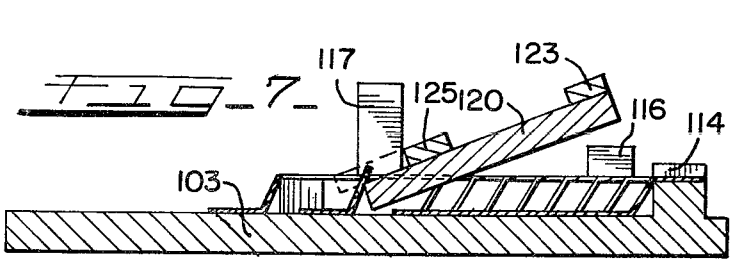
FIG. 7 is a longitudinal section showing the jig base with the partially broken blank thereon and the breaking plunger in an intermediate position the view being taken on the line 7—7 of FIG. 6.

The plunger member 104 comprises a U-shaped frame 120 having legs 122, 122' of a length and width corresponding approximately to the length and width of the bottom wall forming strip panel portions 60 and 60' and spaced apart so as to engage the strip panel portions 60 and 60' when engaged with the blank as shown in FIG. 7. The leg members 122, 122' have a depth corresponding to the depth of the tray and a width corresponding to the width of the panel portions 60 and 60'. The leg members 122 and 122' are connected at their ends by a top cross plate 123, as shown in FIG. 5. A longer plate-like bar 124 is located some distance forwardly of the bight forming cross bar portion 125 of the frame 120 which bar 124 extends laterally of the legs 122, 122' and terminates at two short leg members 126, 126', the latter being rearwardly directed and spaced apart only slightly more than the distance between the outside faces of the posts 117, 117'.

Figure 2:
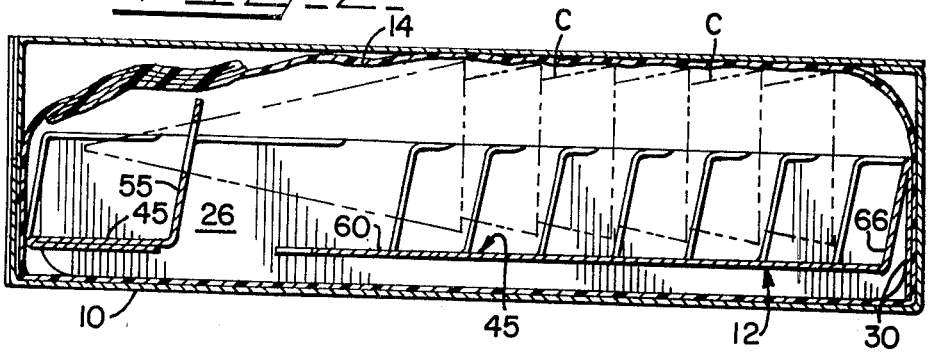
FIG. 2 is a longitudinal sectional view, the view being taken on a plane extending through the completed package and on the line indicated at 2—2 in FIG. 1.
Figure 3:
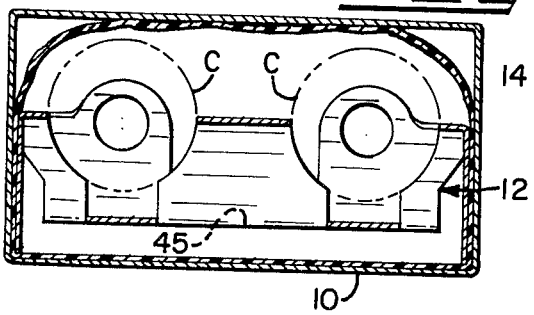
FIG. 3 is a cross sectional view, taken on a plane extending through the completed package and on the line indicated at 3—3 of FIG. 1.
Figure 8:
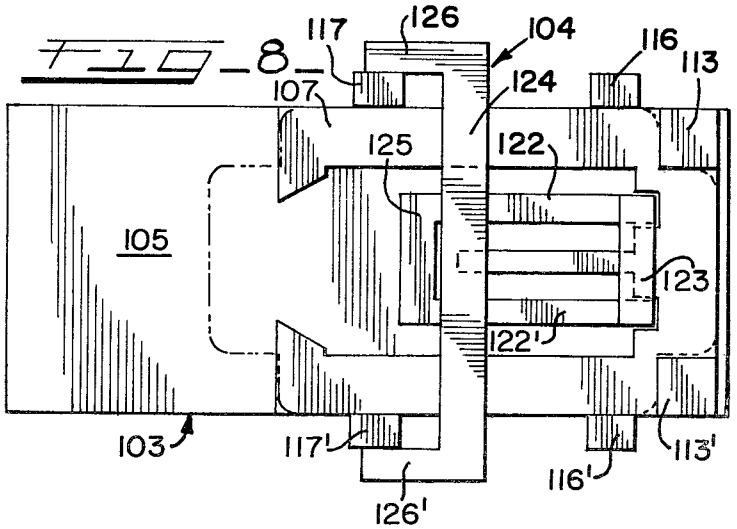
FIG. 8 is a plan view of the jig base and plunger in final position, the outline of the blank being shown in phantom line.

In the use of the jib members 103 and 104, the blank 20 is positioned on the base member as shown in FIG. 6 with the posts 116, 116' and 117, 117' acting as position guides. The plunger 104 is lowered on the blank 20 with the forward end tilted upwardly and the cross bar 124 resting against the forward faces of the posts 117, 117' which will depress the trailing end of the panel 45 and start the swing of the bottom wall panels 60, 60' to a lowered position. The plunger 104 is then hinged downwardly to depress the panels 60, 60' after which the plunger is moved forwardly to the final position as shown in FIG. 8 which swings the cross partition panels 73, 73' and 74, 74' into vertical planes. All that remains to set up the tray is to fold down the sidewall and end wall panels 26, 26' and 30, 36, 36' into wall forming position and swing the flap 37 into position on the bottom as shown in FIG. 2.

What is claimed is:

1. In a package assembly for a plurality of articles having a cone shape wherein the articles are arranged in telescoped, stacked relation and enclosed in a tubular outer carton, a cone holding tray formed from a single sheet of paperboard which is cut and scored to provide bottom, side and end wall panels with a top wall panel structure from which side and end wall panels depend, said bottom wall panel comprising a pair of laterally spaced relatively narrow strip portions hingedly connected at one end of the tray to the top edge of the one end wall by narrow hinge panels which extend downwardly of said end wall so as to lie along the inner face of said end wall, said strip portions extending in parallel relation to a wide panel portion at the other end of the tray which has its terminal edge hinged to an edge portion of a flap member which flap member has a hinged connection with the bottom edge of the end wall and is folded against the outer face of the bottom wall, said top wall panel structure comprising a longitudinally extending panel strip portion which is spaced midway between said bottom wall strip portions and which extends from a hinged connection with the top edge of said end wall panel to which said bottom wall strip portions being hingedly connected along their outside edges to a plurality of upstanding cross partition panels of narrow width which are hinged at the top to the associated sidewall, and said bottom wall strip portions being hingedly connected along their inside edges to upstanding cross partition panels which are hinged at the top to said top wall panel strip portion.

2. In a package assembly as set forth in claim 1 wherein said wide panel portion of said bottom wall panel structure has cut therefrom a pair of cross partition panels which are integrally hinged thereto at the bottom thereof and hingedly connected at the top to a small top panel which extends inwardly of the top edge of the sidewall, said pair of cross partition panels being spaced intermediate the end of the tray and the innermost ends of said bottom wall forming strip portions and each thereof being apertured to engage and hold an end portion of a stack of articles.

3. In a package assembly as set forth in claim 1 wherein said wide panel portion of said bottom wall panel structure has side edge portions tapering inwardly in converging relation to a hinged connection at the bottom edge of the endwall panel to which it is connected by said flap member.

4. In a package assembly as set forth in claim 3 wherein said wide panel portion of said bottom wall panel structure has a pair of cross partition panels cut from the material in the side margins thereof, said partition panels being hingedly connected thereto on transverse hinge lines which are in spaced relation to the endwall, for positioning in upright relation , said hinge lines being disposed in spaced relation to the end wall, and said partition panels each having apertures for receiving portions of an end article in a stack of the articles.

5. In a package assembly as set forth in claim 1 wherein said wide panel portion of said bottom wall panel structure has its opposite side edges freed from the adjacent side wall panels, and wherein a pair of cross partition panels are cut in side marginal portions thereof which are hingedly connected to said marginal portions on transverse hinge lines and which extend to a hinged connection with a top panel portion extending from the adjacent sidewall, whereby said cross partition panels are disposed in an upright position when the wide panel portion is in position in the plane of the bottom wall, and said cross partition panels each having means to engage portions of the end article in a stack of the articles.

6. In a package assembly as set forth in claim 1 wherein said cross partition panels are hinged at their bottom ends to said bottom wall strip portions on hinge lines extending transversely of said bottom wall strip portions and at their upper ends to top wall forming panel portions on hinge lines extending transversely of said top wall so that they extend in generally vertical transverse planes for engagement of the edges with the articles.

7. In a package asembly as set forth in claim 6 wherein said cross partition forming panels have their article engaging edges in part cut so as to conform to the surface of the articles they engage and wherein said cross partition forming panels are spaced and positioned longitudinally of the associated strip portions so as to engage the rim of one article in a stack thereof and also to engage the surface of the next article in the stack.

8. In a package assembly as set forth in claim 1 wherein said cross partition forming panels are hinged at the top and bottom forming ends to top wall and bottom wall forming panel portions, with the hinge lines extending transversely of the tray, said hinge lines of each cross partition forming panel being spaced an equal distance from the corresponding hinge line of the next adjacent panel and said distance corresponding to the depth of the tray.

9. In a package assembly as set forth in claim 8 wherein said cross partition forming panels are arranged in pairs and on opposite sides of said bottom wall forming panel portions with the panels of each pair thereof being aligned transversely of the tray.

10. In a package assembly as set forth in claim 9 wherein the end pairs of said cross partition panels, which are remote from said side panel portion of the bottom wall, have their hinge lines at the top end thereof spaced an equal distance from the adjacent end edge fold line of the tray and said cross partition panels having their oppositely disposed edges cut so as to extend toward each other a sufficient distance to provide abutment panels for engagement by the rim of the end article in the stack of articles.

* * * * *

UNITED STATES PATENT AND TRADEMARK OFFICE

CERTIFICATE OF CORRECTION

PATENT NO. : 4,269,316

DATED : May 26, 1981

INVENTOR(S) : Lawrence J. Growney

It is certified that error appears in the above-identified patent and that said Letters Patent are hereby corrected as shown below:

Column 1, line 21, "guage" should read -- gauge --.

Column 2, line 61, "guage" should read -- gauge --.

Column 4, line 58, "latterly" should read -- laterally --.

Column 8, line 4, "wherinsaid" should read -- wherein said --.

Signed and Sealed this

First Day of September 1981

[SEAL]

Attest:

GERALD J. MOSSINGHOFF

Attesting Officer

Commissioner of Patents and Trademarks